US005598831A

United States Patent [19]

Izuta

[11] Patent Number: 5,598,831

[45] Date of Patent: Feb. 4, 1997

[54] HYBRID BOW STRING FORMED FROM STRANDS OF POLYETHYLENE RESIN AND POLYPARABENZAMIDE/POLYBENZO-BISOXAZOLE RESIN

[75] Inventor: Tadao Izuta, Shizuoka, Japan

[73] Assignee: Yamaha Corporation, Japan

[21] Appl. No.: 506,179

[22] Filed: Jul. 25, 1995

[30] Foreign Application Priority Data

Jul. 29, 1994 [JP] Japan ..... 6-196319

[51] Int. Cl.[6] ..... F41B 5/14

[52] U.S. Cl. ..... 124/90; 57/237; 428/364

[58] Field of Search ..... 124/90; 57/236, 57/237; 428/357, 364

[56] References Cited

U.S. PATENT DOCUMENTS

| | | | |
|---|---|---|---|
| 4,198,494 | 4/1980 | Burckel | 525/432 |
| 4,228,218 | 10/1980 | Takayanagi et al. | 525/58 |
| 4,497,868 | 2/1985 | Reinehr et al. | 428/400 |
| 4,528,223 | 7/1985 | Kumazawa et al. | 428/34.5 |
| 4,622,265 | 11/1986 | Yoon et al. | 428/364 |
| 4,783,367 | 11/1988 | Maatman et al. | 428/364 |
| 4,957,807 | 9/1990 | McCullough et al. | 428/222 |
| 5,165,993 | 11/1992 | Van Anholt et al. | 428/364 |
| 5,168,011 | 12/1992 | Kovar et al. | 428/373 |
| 5,371,153 | 12/1994 | Kuribayashi et al. | 525/423 |

FOREIGN PATENT DOCUMENTS

| | | |
|---|---|---|
| 58-27279 | 6/1983 | Japan . |
| 61-175796 | 11/1986 | Japan . |
| 61-175797 | 11/1986 | Japan . |

*Primary Examiner*—John A. Ricci

*Attorney, Agent, or Firm*—Ostrolenk, Faber, Gerb & Soffen, LLP

[57] ABSTRACT

A plurality of first strands are bundled with a plurality of second strands for forming a string used in a bow, and the first strand and the second strand are respectively made from filaments of polyethylene resin and filaments of polyparabenzamide resin or polybenzobisoxazole resin so as to mutually compensate drawbacks of these resins.

11 Claims, 5 Drawing Sheets

HYBRID BOW STRING FORMED FROM STRANDS OF POLYETHYLENE RESIN AND POLYPARABENZAMIDE/POLYBENZO-BISOXAZOLE RESIN

FIELD OF THE INVENTION

This invention relates to a bow string and, more particularly, to a hybrid bow string made from polyethylene resin strands and polyparabenzamide/polybenzobisoxazole resin strands.

DESCRIPTION OF THE RELATED ART

Various strings of a bow are disclosed in Japanese Utility Model Publication of Examined Application No. 58-27279 and Japanese Utility Model Publication of Unexamined Application Nos. 61-175796 and 61-175797. These prior art strings are made from filaments of polyester, filaments of polyparabenzamide resin or filaments of ultra high molecular weight polyethylene resin.

The polyester filament commercially available in Japan are called as Tetron (trade mark) and Dacron (also trade mark). Typical properties of the polyester filament are 1.4 in specific gravity (gram/cubic centimeter), 5.23 in mass (gram) and 150 in spring constant (N).

A typical example of the aramid filament is called as Kevlar (trade mark), and has the specific gravity of 1.45 (gram/cubic centimeter), the mass of 7.77 (gram) and the spring constant of 950 (N).

Tekmilon (trade mark) is a typical example of the polyethylene filament, and the specific gravity, the mass and the spring constant are 0.96 (gram/cubic centimeter), 5.34 (gram) and 950 (N).

The present inventor evaluated the strings formed from these filaments. First, the present inventor measured an initial velocity of an arrow, and plotted that initial velocity of an arrow in terms of a specific elastic modulus of the string as shown in FIG. 1. The string made from the polyester filaments was represented by a small triangle at point A, and dots B1 and B2 were representative of the strings made from the aramid filaments. The string made from the polyethylene filaments was represented by a small bubble at point C.

The string made from the polyester filaments, the string made from the aramid filaments and the string made from the polyethylene filaments are hereinbelow referred to as "string A", "string B" and "string C", respectively.

The present inventor further plotted the initial velocity in terms of the draw-length of the prior art strings A, B and C as shown in FIG. 2.

Although the aramid was equal in the spring constant to the polyethylene, the string C had greater draw-length than the string B, and gave the larger initial velocity to the arrow than the string B.

The string A made from the polyester filaments was the least in the draw-length and the initial velocity. Moreover, the string A was the weakest against heat, and the dimensions were unstable at ambient high temperature. However, the string A was the most preferable in view of production cost, and was most durable in repeated use at room temperature.

The string B was dimensionally stable. However, the string B was liable to be easily broken in the repeated use.

As discussed in conjunction with FIGS. 1 and 2, the string C was the most preferable in view of the initial velocity of the arrow. However, the string C was not excellent. The string C was very costly, and was small in the restoring kinetic energy. Moreover, the string C was deformable at ambient high temperature, and the string height was variable under the blazing sun. The evaluation is summarized in the following table.

| item | evaluation | | |
|---|---|---|---|
| Initial velocity of arrow | C> | B> | A |
| durability of string | A≧ | C>> | B |
| stability of dimensions (ductility heat) | B > | C>> | A |
| low price | A> | B≧ | C |

In this situation, the strings made from the polyester filaments are mainly used by beginners, and the strings made from the aramid filaments have been superseded with the strings made from the polyethylene filaments. Nevertheless, the strings A and C do not perfectly satisfy bowmen.

SUMMARY OF THE INVENTION

It is therefore an important object of the present invention to provide a string which imparts a large initial velocity to an arrow and is large in the restoring kinetic energy.

The present inventor contemplated the properties of compound resin fibers and the motion of the string stretched over a bow. If strings were equal in spring constant, the initial velocity of an arrow was in inverse proportion to the mass of the string. On the other hand, if strings were equal in mass, the initial velocity of an arrow was in proportion to the spring constant of the string. Therefore, a light string with a large spring constant was preferable in view of the initial velocity of an arrow.

Next, in order to enhance the stability of a string in a restoring motion after a release, it was effective to increase the restoring kinetic energy of the string. This meant increase of the mass of the string and the initial velocity of the arrow, i.e., decrease of remaining energy.

A high-grade aramid resin filament was the optimum in view of the large spring constant. However, the life time was a tenth of the other filaments, and a bowman took a risk of the breakage of string made from the aramid filaments. The aramid filament was 1.5 times larger in density than the polyethylene filament, and this property and acceleration by virtue of the large spring constant resulted in a large restoring kinetic energy of the string. Moreover, the ductility was small, and the string height was stable.

To accomplish the object, the present invention proposes to work out a compromise between different compound resins.

In accordance with one aspect of the present invention, there is provided a string for a bow comprising: a plurality of first strands each formed from filaments of ultra high molecular weight polyethylene resin; and a plurality of second strands bundled with the plurality of first strands, each of the plurality of second strands being formed from filaments of polyparabenzamide resin.

In accordance with another aspect of the present invention, there is provided a string for a bow comprising: first strands each formed from a plurality of filaments of ultra high molecular weight polyethylene; and second strands each formed from a plurality of filaments of polybenzobisoxazole resin and bundled with the first strands.

In accordance with yet another aspect of the present invention, there is provided a bow string comprising a plurality of commingle yarns bundled together through a wrench, each of the commingle yarns including a plurality of bundles of ultra high molecular weight polyethylene resin filaments and a plurality of bundles of polyparabenzamide resin filaments.

BRIEF DESCRIPTION OF THE DRAWINGS

The features and advantages of the string used in the bow according to the present invention will be more clearly understood from the following description taken in conjunction with the accompanying drawings in which.

DESCRIPTION OF THE PREFERRED EMBODIMENTS

First Embodiment

Figure 1:
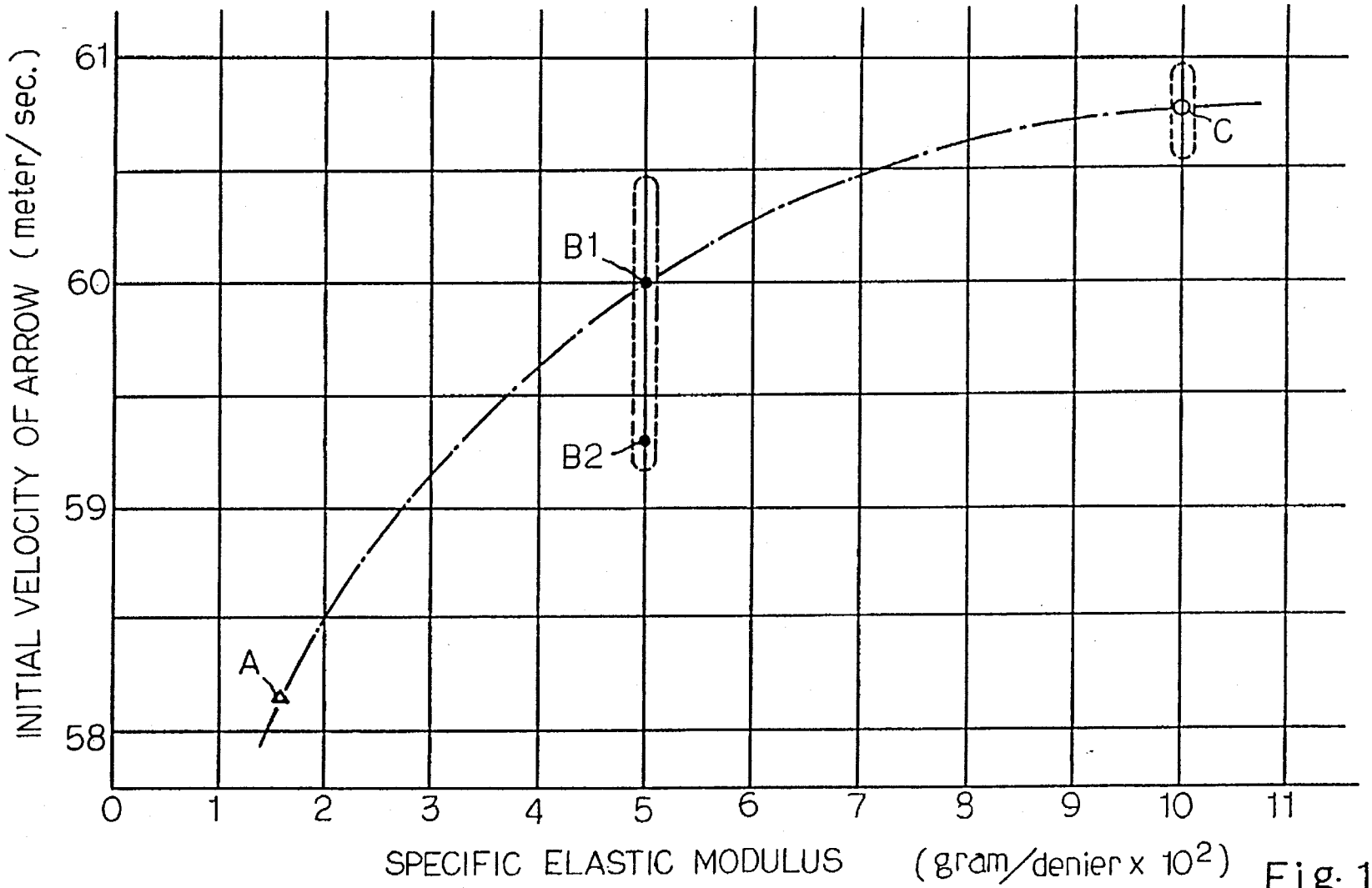
Fig. 1 PRIOR ART
FIG. 1 is a graph showing the initial velocity of the arrow in terms of the specific elastic modulus of the prior art strings.
Figure 2:
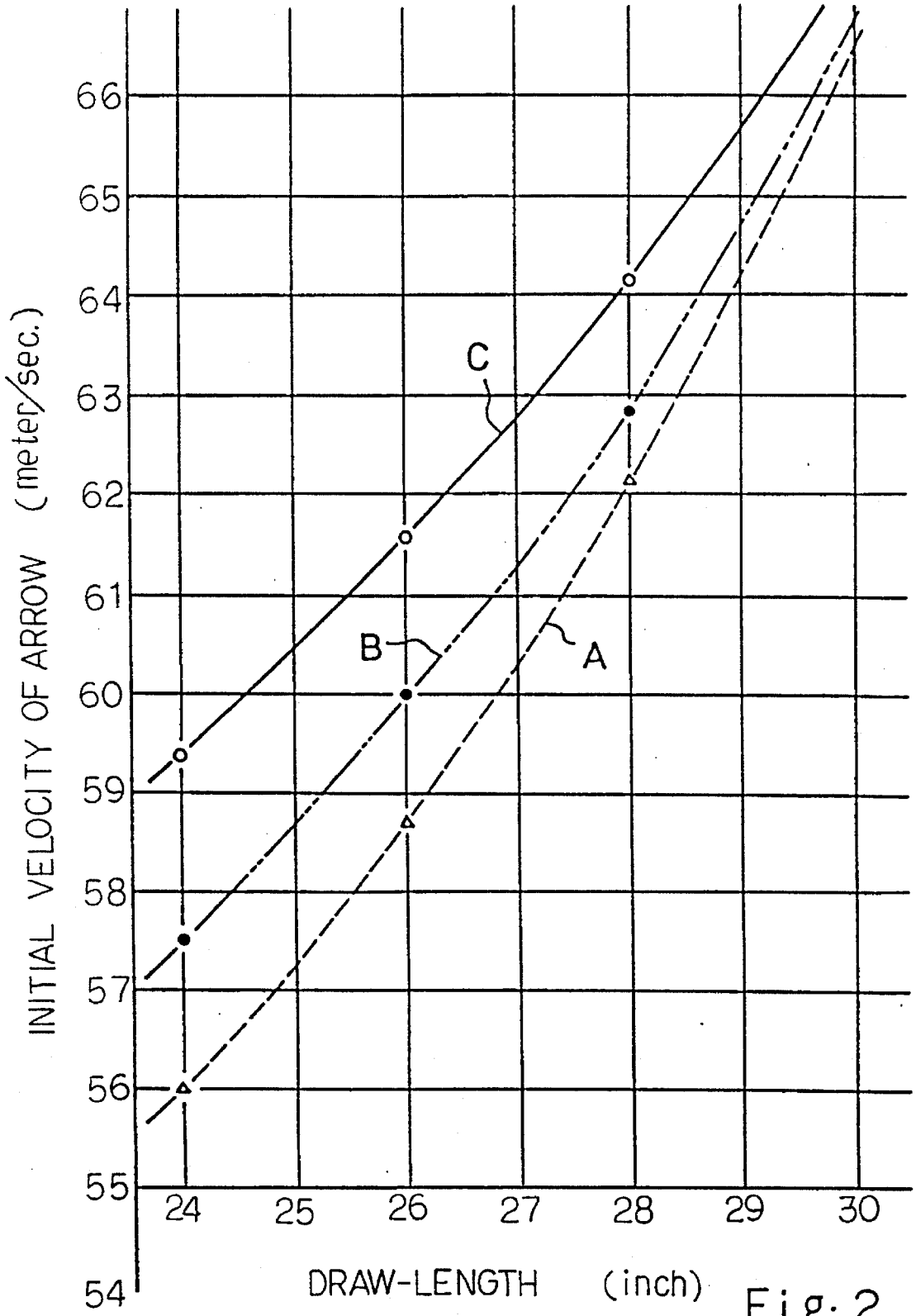
Fig. 2 PRIOR ART
FIG. 2 is a graph showing the initial velocity of the arrow in terms of the draw-length of the prior art strings.
Figure 3:
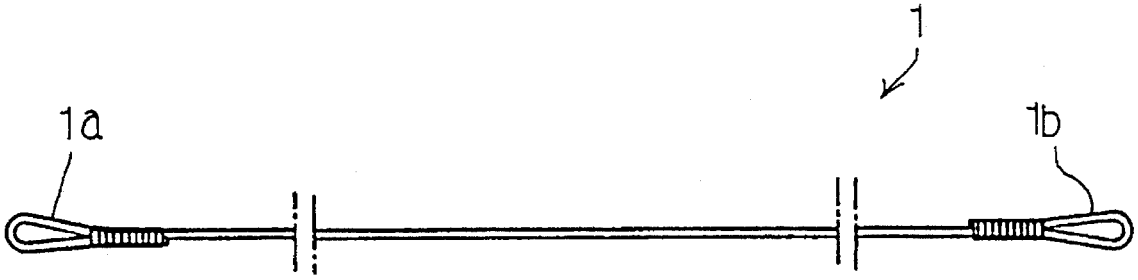
FIG. 3 is a front view showing a bow string according to the present invention.
Figure 4:
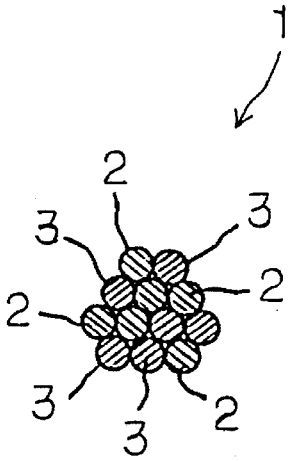
FIG. 4 is a cross sectional view showing the bow string according to the present invention.

FIG. 3 illustrates a bow string 1 embodying the present invention. Both end portions 1*a* and 1*b* of the string 1 are folded, and are fixed to inside portions of the bow string 1 by means of wound thread so as to form hoops. The hoops are caught by tips of upper and lower limb portions of the bow (not shown), and, accordingly, the bow string 1 is stretched between the tips.

FIG. 3 shows a cross section of the string 1. A plurality of first strands 2 and a plurality of second strands 3 are bundled, and form the bow string 1.

Each of the first strands 2 is made from first filaments of ultra high molecular weight polyethylene resin. The thickness of the first filament is 5 to 20 denier, and the specific gravity ranges from 0.96 to 0.98. The elastic modulus for a tensile force falls within the range between 80 GPa to 150 GPa.

On the other hand, the second strand 3 is made from second filaments of polyparabenzamide resin, and the thickness of the second filament is 1 to 15 denier. The elastic modulus for the tensile force ranges from 100 GPa to 180 GPa, and the specific gravity falls within the range between 1.43 and 1.48.

The first filaments are twisted into first yarns, and the second are also twisted into second yarns. The first and second yarns are bundled through a twisting motion so as to obtain the first and second strands 2 and 3. The first strands and the second strands 2 and 3 are twisted so as to obtain a string. The string is coated with wax. Both end portions of the string are foiled and fixed so as to complete the string 1.

The bow string 1 was tailored for a 66-inch bow, the weight of the string 1 ranged from 5.8 grams to 6.8 grams. The ductility of the string 1 was 0.4 to 0.8 percent under the load of 50 kilograms. The spring constant fell within the range between 1500N to 3000N while the ductility increased at 0.2 percent.

The string I ranges from 800 denier to 4000 denier. It is more preferable that the thickness of the string 1 falls within the range between 1000 denier and 2000 denier. In this instance, the second strands 3 are 15 percent to 60percent of the denier of the string 1. However, the range between 25 percent and 45 percent is more appropriate.

As described hereinbefore, the first filaments and the second filaments are respectively twisted and bundled into the first strands 2 and the second strands 3. The first strands 2 and the second strands 3 are twisted and bundled into the string 1. The second strand is twisted as many times as the first strand or more times than the first strand. For example, if the string 1 is 500 denier, it is twisted 500 times per meter. If the string 1 is 2000 denier, it is twisted not greater than 250 times. It is desirable that the twisting is Z-turn.

If the number of the twists is increased, the ductility of the string 1 is also increased, and it absorbs the impact at the release of an arrow. Moreover, the dupability of the string 1 is improved. However, the spring constant of the string 1 is decreased roughly in proportion to the number of the twists, and the initial velocity of the arrow is decreased due to the increase of the mass per unit length.

A bundle of the first strands 2 and a bundle of the second strands 3 are dealt with the pre-twist, and 2–6 strands form the bundle. If the string 1 is 1000 denier, the bundle of the first strands is twisted with the bundle of the second strands 300 times per 1 meter. If the denier is increased to 4000, the bundles are twisted not greater than 150 times. The twisting is preferably S-turn.

In the above described example, the first strands and the second strands are pre-twisted. However, the first filaments of polyethylene resin may be simply bundled into the first strands without the pre-twist, and only the second filaments of aramid resin are formed into the second strands through the pre-twist. The bundle of the first filaments is twisted with the bundle of the second strands 3.

In yet another implementation, 2 to 6 first strands 2 and the second strands are bundled without the pre-twist so as to be 400 to 2000 denier in thickness. The bundle is twisted, and is completed into the string 1. If the string 1 is 1000 denier, it is twisted 300 times per meter. If the twist is increased to 4000 denier, the number of twists is not greater than 150. The twisting direction is preferably Z-turn.

In still another implementation, 2–4first strands 2 and the second strands 3 are bundled at without the pre-twist so as to be 800 to 4000 denier in thickness, and the bundle of the first strands 2 and the bundle of the second strands 3 are respectively twisted. If the string 1 is 1000 denier, the number of the twists is 300 per meter. When the denier is increased to 4000, the number of twists is not greater than 150. The twisting direction is preferably S-turn.

In the above examples, the second strands 3 are formed from the filaments of polyparabenzamide resin. However, the second strands 3 may be formed from the second filaments of polybenzobisoxazole resin. The composition ratio of the second filaments of polybenzobisoxazole resin is equal to that of the second filaments of polyparabenzamide resin, and ranges from 15 percent to 60 percent. The composition ratio between 25 percent and 45 percent is more preferable.

The second filament of polybenzobisoxazole resin is 1.53 to 1.56 in the specific gravity (gram/cubic centimeter), and is twice as large in strength and elastic modulus than the filament of aramid resin.

As described hereinbefore, the string is coated with wax, and the weight of the string is regulable by changing the amount of wax.

As will be appreciated from the foregoing description, each of the first strands 2 of polyethylene and the second strands 3 of polyparabenzamide/polybenzobisoxazole compensates the drawbacks inherent in the individual resin, and the string according to the present invention not only imparts large initial velocity to an arrow but also maximizes the restoring kinetic energy thereof. The return of the string 1 becomes stable, and the durability is improved. The stability of the string height is enhanced. As a result, the arrow flies along a low ballistic path, and the hit ratio is enhanced.

Second Embodiment

Figure 5:
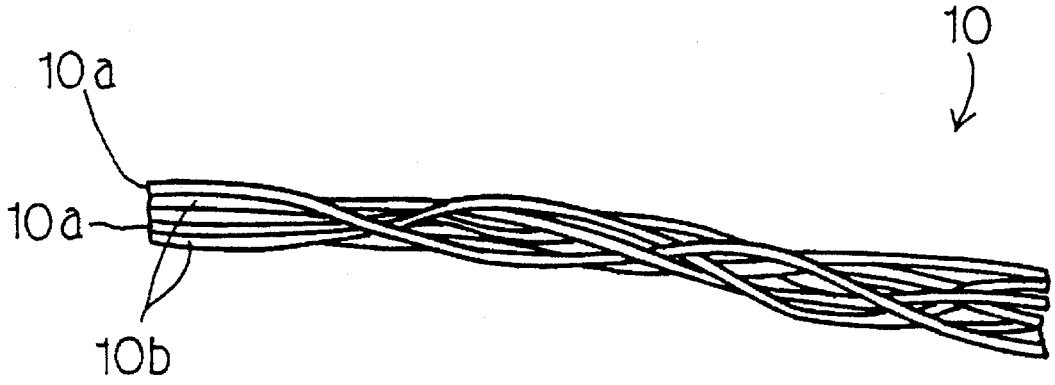
FIG. 5 is a front view showing a commingle yarn used for another bow string according to the present invention.

Turning to FIG. 5 of the drawings, a commingle yarn 10 is formed from bundles 10*a* of ultra high molecular weight polyethylene resin filaments and bundles 10*b* of polyparabenzamide resin. The filament of polyethylene resin and the filament of polyparabenzamide resin are similar to those of the first embodiment. The bundles 10*a* of polyethylene resin are twisted with the bundles 10*b* of the polyparabenzamide resin so as to obtain the commingle yarn 10.

Figure 6:
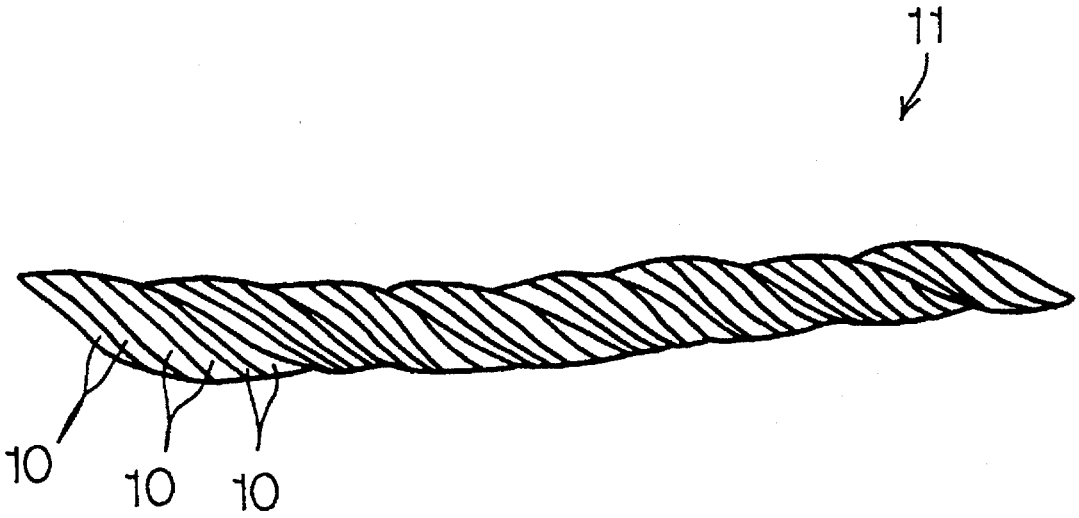
FIG. 6 is a front view showing the bow string using the commingle yarn according to the present invention.
Figure 7:
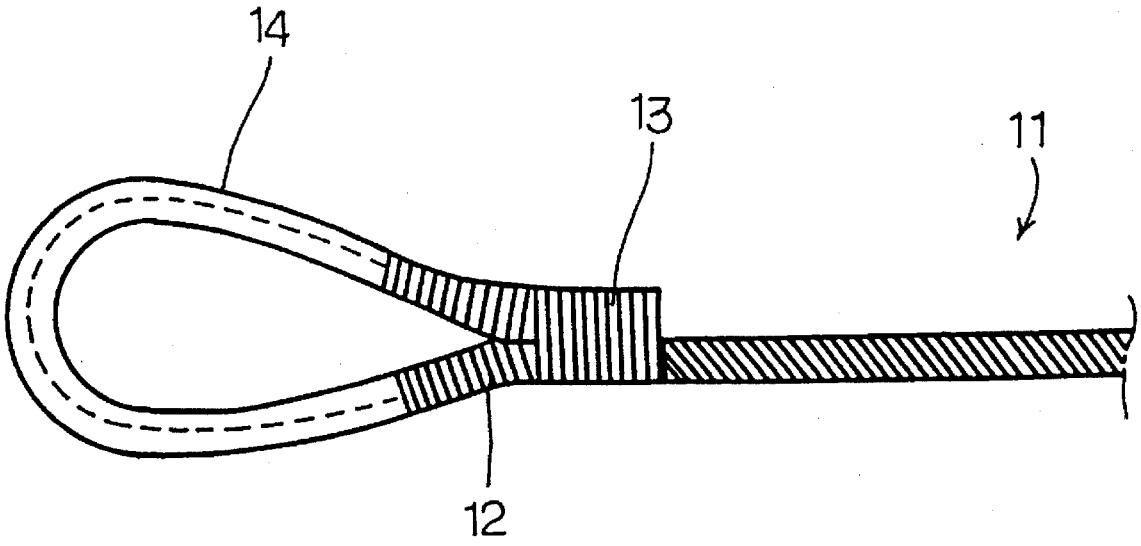
FIG. 7 is a front view showing a hoop of the bow string shown according to the present invention.

A plurality of commingle yarns 10 are bundled together, and are wrenched as shown in FIG. 6. Threads 12 are wound on both ends of the wrenched bundle 11 (see FIG. 7), and do not allow the wrenched bundle 11 to return. Both end portions are folded, and threads 13 are wound so as to fix both end portions to inside portions of the bow string 11. Both end portions thus folded form hoops 14, respectively.

The commingle yarn 10 ranges from 800 denier to 4000 denier, and the polyparabenzamide resin filaments occupies 15 to 60 percent of the total denier of the commingle yarn 10. The occupation ratio between 25 percent to 45 percent is more desirable. The bundle of commingle yarns 11 falls within the range between 1000 denier and 2000 denier upon the wrench.

The bow string 11 was tailored for a 66-inch bow, the weight of the bow string 21 ranged from 5.8 grams to 6.8 grams. The ductility of the string 1 was 0.4 to 0.8 percent under the load of 50 kilograms. The spring constant fell within the range between 1500N to 3000N while the ductility increased at 0.2 percent.

There are several modifications of the second embodiment. In the first modification, each of the bundles 10*a* and 10*b* of filaments is twisted before forming the commingle yarn 10. If the bundle 10*a*/10*b* is 500 denier, the bundle 10*a*/10*b* is twisted five hundreds times per meter. If the bundle 10*a*/10*b* is 2000 denier, the bundle 10*a*/10*b* is twisted two hundreds and fifth times or less per meter. z-turn is desirable.

It is desirable to twist the bundle of polyparabenzamide resin filaments more than the bundle of polyethylene resin filaments.

In general, the more twist, the larger the ductility. However, if the twist is increased, the spring constant is decreased, and the mass is increased. The increase of mass results in insufficient acceleration of an arrow. The above twisting range enhances the durability of the bow string 11.

Two to six bundles 10*a*/10*b* are twisted so as to form the commingle yarn 10. The number of turns depends upon the denier of the bundles 10*a*/10*b*. If the bundles 10*a*/10*b* are 1000 denier, the turns is three hundred times per meter. If the bundles 10*a*/10*b* are 4000 denier, the turns are a hundred and fifty times or less per meter.

In the second modification, the bundle 10*b* of polyparabenzamide resin filaments is twisted before forming the commingle yarn 10 . However, the bundle 10*a* of polyethylene resin filaments is not twisted before forming the commingle yarn 10. The bundles 10*a* are twisted with the bundles 10*b* previously twisted so as to obtain the commingle yarn 10.

In the third modification, the commingle yarn 10 is formed from the bundles of polyethylene resin filaments and the bundles of polyparabenzamide resin filaments, and all of the bundles are not previously twisted. The total denier of two to six commingle yarns 10 are bundled, and the bundle of the commingle yarns 10 ranges from 400 to 2000. The bundle of the commingle yarns 10 is wrenched into the bow string 11 through the Z-turn. The number of turns is equal to that of the second modification.

The fourth modification is similar to the third modification. Two to four commingle yarns are bundled, and the bundle of commingle yarns ranges between 800 denier and 4000 denier. The twisting range is equal to the first modification.

Although particular embodiments of the present invention have been shown and described, it will be obvious to those skilled in the art that various changes and modifications may be made without departing from the spirit and scope of the present invention.

What is claimed is:

1. A string for a bow comprising:

a plurality of first strands each formed from filaments of ultra high molecular weight polyethylene resin; and a plurality of second strands bundled with said plurality of first strands, each of said plurality of second strands being formed from filaments of resin selected from the group consisting of polyparabenzamide and polybenzobisoxazole.

2. The string as set forth in claim 1 in which said plurality of second strands are formed from filaments of polyparabenzamide resin.

3. The string as set forth in claim 2, in which each of said filaments of each first strand is 5 to 20 denier in thickness, 80 to 150 GPa in tensile elastic modulus and 0.96 to 0.98 in specific gravity, and each of said filaments of each second strand is 1 to 15 denier in thickness, 100 to 180 GPa in tensile elastic modulus and 1.43 to 1.48 in specific gravity.

4. The string as set forth in claim 2, in which the content of said second strands is from 15 percent to 60 percent with respect to said string.

5. The string as set forth in claim 4 in which the content of said second strings is between 25% and 45%.

6. The string as set forth in claim 2, in which said first strands and said second strands form a first bundle and a second bundle, and said first bundle and said second bundle are respectively twisted.

7. The string as set forth in claim 2, in which said first strands and said second strands are twisted into a first bundle and a second bundle, and said first bundle is twisted with said second bundle.

8. The string as set forth in claim 2, in which said second strands are twisted, and are bundled with said first strands.

9. A string for a bow comprising:

first strands each formed from a plurality of filaments of ultra high molecular weight polyethylene; and second strands each formed from a plurality of filaments of polybenzobisoxazole resin and bundled with said first strands.

10. A bow string comprising a plurality of commingle yarns bundled together through a wrench, each of said commingle yarns including a plurality of bundles of ultra high molecular weight polyethylene resin filaments and a plurality of bundles of polyparabenzamide resin filaments.

11. The bow string as set forth in claim 10 having a layer of wax on the surface thereof.

* * * * *